US005730071A

United States Patent [19]

Wasyluk et al.

[11] Patent Number: 5,730,071

[45] Date of Patent: Mar. 24, 1998

[54] SYSTEM TO IMPROVE MIXING AND UNIFORMITY OF FURNACE COMBUSTION GASES IN A CYCLONE FIRED BOILER

[75] Inventors: David T. Wasyluk, Mogadore; Martin P. Johns, Stow; Larry P. Rouch, Barberton, all of Ohio

[73] Assignee: The Babcock & Wilcox Company, New Orleans, La.

[21] Appl. No.: 587,049

[22] Filed: Jan. 16, 1996

[51] Int. Cl.[6] ..... F23M 9/00; F23M 9/10

[52] U.S. Cl. ..... 110/322; 110/323; 110/337; 110/234; 110/210; 110/213; 110/264; 422/146; 122/235.11; 122/235.12

[58] Field of Search ..... 110/210, 211, 110/212, 213, 214, 233, 234, 263, 264, 265, 336, 337, 322, 323, 324, 325, 326; 122/6 A, 235.11, 235.12, 355, 356

[56] References Cited

U.S. PATENT DOCUMENTS

| | | | |
|---|---|---|---|
| 1,889,861 | 12/1932 | Huet | 122/355 |
| 2,918,024 | 12/1959 | Seidl | 110/264 |
| 3,135,243 | 6/1964 | Schroedter | 122/6 A |
| 3,457,903 | 7/1969 | Huge | 122/235.11 |
| 4,191,133 | 3/1980 | Stevens | 122/325 R |
| 4,298,355 | 11/1981 | Staudinger | 48/206 |
| 4,323,366 | 4/1982 | Staudinger | 48/73 |
| 4,475,849 | 10/1984 | Hilgraf | 406/163 |
| 4,480,557 | 11/1984 | Hochmuth | 110/234 |
| 4,513,694 | 4/1985 | Wiemer | 122/7 R |
| 4,586,443 | 5/1986 | Burge et al. | 110/347 |
| 4,763,584 | 8/1988 | Zieren | 110/323 |
| 4,809,621 | 3/1989 | Materna | 110/323 |
| 4,986,199 | 1/1991 | Komeno et al. | 110/347 |
| 5,022,329 | 6/1991 | Rackley et al. | 110/234 |
| 5,042,400 | 8/1991 | Shiraha et al. | 110/244 |
| 5,044,286 | 9/1991 | Breen et al. | 110/165 A |
| 5,052,312 | 10/1991 | Rackley et al. | 110/346 |
| 5,091,156 | 2/1992 | Ijas et al. | 422/146 |

OTHER PUBLICATIONS

"Steam/Its Generation and Use", 40th ed., The Babcock & Wilcox Company, pp. 14–1 to 14–11, 1992.

*Primary Examiner*—Ira S. Lazarus
*Assistant Examiner*—Ljiljana V. Ciric
*Attorney, Agent, or Firm*—Daniel S. Kalks; Robert J. Edwards

[57] ABSTRACT

An apparatus for improving mixing and uniformity of furnace combustion gases in a boiler includes a slag screen 50, slag screen baffle 62 with a plurality of wingwall sections 52 situated between cyclone burner riser sections 64. This arrangement improves overall distribution of the burner exit gases 56 and uniformity by reducing stratification of the gases 58 exiting the burner. Additionally, the present invention increases the heat transfer effectiveness and ash collecting capability.

7 Claims, 4 Drawing Sheets

SYSTEM TO IMPROVE MIXING AND UNIFORMITY OF FURNACE COMBUSTION GASES IN A CYCLONE FIRED BOILER

BACKGROUND OF THE INVENTION

1. Field of the Invention

The present invention relates in general to boilers and, in particular, to cyclone boilers which utilize a unique combination of a slag screen and a wingwall section for improving furnace operation.

2. Background of the Related Art

FIG. 1A depicts a conventional cyclone-fired steam boiler 10. Cyclone firing is used for solid fuels with relatively low ash melting points. One or more cyclones 12 are mounted on the furnace front wall 14. A cyclone is essentially a water-cooled horizontal cylinder that is 6 to 10 ft. in diameter (analogous to a large burner). The inside 16 of the cyclone is refractory-lined to maintain high combustion temperatures. Combustion air is admitted tangentially at 18. This produces a turbulent swirling or cyclonic flow of combustion gases 20 that exit at 22, into a lower furnace 24. A molten slag layer develops and coats the cyclone's internal refractory lining. The slag drains to the bottom of the cyclone and then to the furnace floor 28 where it is discharged through a slag tap 26 in the furnace floor 28.

The shallow lower furnace configuration consists of a rear wall 30 which is in close proximity to the front wall 14. In this configuration, the rear wall serves as a target wall for cyclone exit gases to impinge on, in order to help capture additional ash entrained in the gases. The lower furnace is a completely water-cooled, membrane tube panel construction. It is also refractory-lined and small in volume (relative to the upper furnace) in order to maintain high gas temperatures and a molten slag layer on the furnace walls to promote downward slag flow.

The bare (i.e. not refractory-covered), water-cooled membrane upper furnace walls cool the combustion gases below the ash melting point to avoid slagging of the convection pass heating surface. Cyclone riser 32 and saturated platen tube sections 34 (FIGS. 1A and 1C), which are widely spaced across the width of the front and rear walls respectively, also absorb heat from the furnace gases. Each of these sections consist of a row of in-line tubes which resemble a sheet or panel due to the very close spacing between tubes. The refractory of the lower furnace walls extends up to an upper refractory edge 31 in FIG. 1A.

A disadvantage of the shallow furnace design is that it causes most of the cyclone exit gases to flow up the furnace rear wall 30 due to direct impingement of the gases on the rear wall. In addition, the gas flows and temperatures tend to be higher at the cyclone centerlines. This pattern of stratified gases generally continues up through the upper furnace and into the convection pass heating surfaces 36. Hence, the net effects from furnace gas stratification are higher operating and/or maintenance costs and/or lower unit availability due to:

- Increased furnace slagging in areas of high temperature and concentrated gas flow which increases refractory maintenance and requires more frequent on-line soot-blowing and unit shutdowns for water washing to maintain furnace heat transfer effectiveness;
- Reduced furnace heat transfer (due to ineffective use of surfaces) and higher gas temperatures entering convection pass which increases convection pass fouling and plugging and in turn reduces unit efficiency and increases gas velocities and tube erosion;

- Side-to-side and vertical imbalances of gas flow and temperature entering convection pass heating surfaces. which results in uneven heat transfer; and
- Less uniform natural water circulation within the furnace waterwalls.

Although the cyclone riser sections and saturated platens help to improve side-to-side gas distribution somewhat in the upper furnace, significant stratification along the rear wall can still occur. Furthermore, the transverse spacing of the cyclone riser sections is too large to cause any significant side-to-side gas redistribution.

FIG. 1B depicts an alternate furnace arrangement which includes a slag screen 40. Slag screens have been used with deeper lower furnaces (also water-cooled and refractory-lined) primarily to increase the capture of entrained ash. In this configuration, the cyclone exit gases 42 are diverted downward by a slag screen baffle 44 (which is constructed of a bent, water-cooled membrane tube panel) and then up through the screen tube bank 40 (a staggered tube bank that is an extension of the lower end of the screen baffle tubes). This arrangement provides more contact surface, a more tortuous path and longer residence time for the gases in the hot, refractory zone which in turn increases the potential for capturing entrained ash. An additional advantage of the slag screen is that it improves side to side gas distribution entering the upper furnace. Although gas stratification along the rear wall is reduced, it is not eliminated because the gas flows are higher near the floor and rear wall due to the change in direction as the gas turns upward.

Additional information concerning cyclone furnaces can be found in the publication *STEAM, ITS GENERATION AND USE,* 40th ed., 1992, published by The Babcock and Wilcox Company, at pp. 40-1 to 40-11.

SUMMARY OF THE INVENTION

An object of the present invention is to provide an apparatus for improving mixing and uniformity of furnace combustion gases in a boiler having a lower furnace with a front wall, a rear wall, and a furnace floor, the apparatus comprising a burner having an outlet for combustion gases opening into the front wall of the furnace for discharging the combustion gases horizontally into the furnace; a slag screen baffle situated in the lower furnace and spaced away from the burner outlet, the baffle including an inclined upper part extending to the front wall; a slag screen in the lower furnace extending toward the rear wall of the lower furnace from a lower end of the slag screen baffle, the slag screen passing combustion gases from the burner outlet which are diverted first downwardly by the slag screen baffle and then upwardly through the slag screen; a wingwall section extending from the front wall into the furnace and above the lower furnace, past which the combustion gases flow for being cooled by the wingwall section; and a furnace nose extending into the furnace from the rear wall of the furnace and above the lower furnace for diverting the combustion gases between the wingwall sections.

Another object of the present invention is to form the slag screen, slag screen baffle and wingwall sections of tube walls for passing a cooling fluid, the cooling fluid passing between the slag screen, the slag screen baffle and the wingwall sections.

A still further object of the invention is to utilize a cyclone burner as the burner, the cyclone burner being capable of burning various combinations of solid, liquid and gaseous fuel.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 2A:
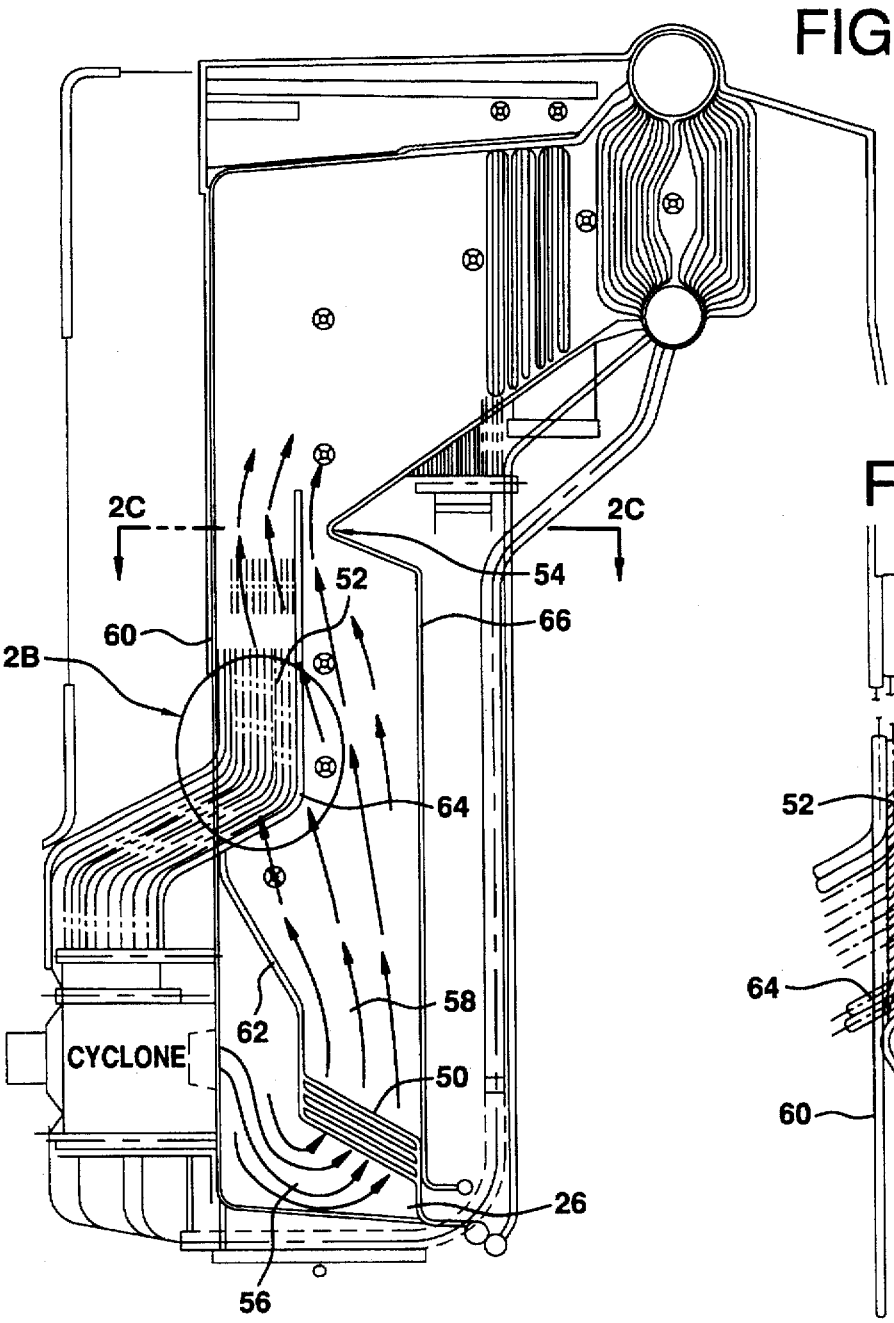
FIG. 2A is a schematic side elevational view of a cyclone-fired boiler which incorporates the apparatus of the present invention.
Figure 2B:
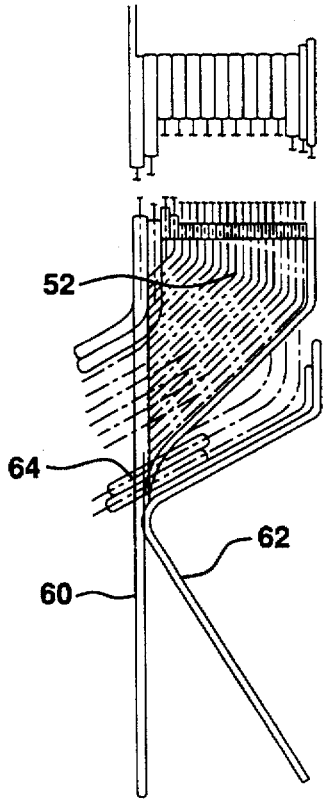
FIG. 2B is a detail taken from area 2B of FIG. 2A.
Figure 2C:
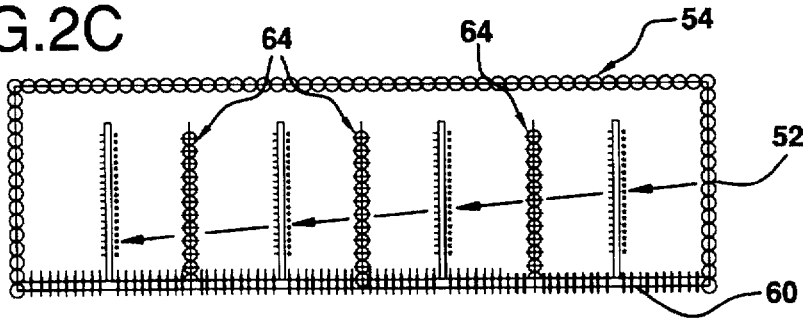
FIG. 2C is a sectional view taken along 2C—2C of FIG. 2A.

As shown in FIGS. 2A, 2B and 2C, this invention essentially involves a rearrangement of a slag screen 50, addition of upper furnace wingwall sections 52, addition of a furnace nose (also known as an arch) 54, and elimination of saturated platen sections used in the prior art. This system is believed to improve mixing and uniformity (i.e. reduce stratification) of combustion gases flowing up through the furnace and into the convection pass heating surface.

The rearrangement of the slag screen 50 involves a reduced transverse tube spacing (perpendicular to gas flow) which is intended to create additional resistance to gas flow due to reduced free flow area. This also is intended to improve the overall distribution of the cyclone exit gases 56 entering the screen and to improve uniformity (i.e. reduce stratification) and mixing of gases 58 exiting the screen and entering the upper furnace in addition to increasing the heat transfer effectiveness and ash collecting capability of the screen.

Wingwall tube sections 52 are added adjacent the upper furnace front wall 60. The wingwall tube sections 52 are an integral part of the slag screen 50 as they are a continuation of the upper end of the screen baffle tubes 62 and are formed by a series of three dimensional tube bends. Since the wingwall tube sections are similar in function and construction to the saturated platens (used in prior art), the saturated platens are eliminated. Compared to the saturated platens, the depth of the wingwall tube sections are increased (i.e. more tubes per section) and are equal in depth to the cyclone burner riser tube sections 64 (FIG. 2B). Also, with the wingwall tube sections located adjacent the front wall 60, they are "nested" between the cyclone burner riser tube sections 64 (FIG. 2C), which significantly reduces the spacing between sections. The combination of deeper wingwall tube sections and nesting them between the cyclone burner riser tube sections is unique and is believed to improve the side to side gas distribution by "channeling" the flue gases up through the entire height of the upper furnace after exiting the slag screen. This is believed to increase furnace heat transfer because the furnace surface may be used more effectively (i.e. more of the gas flow is in contact with furnace surface).

Elimination of the saturated platens along the rear wall 66 creates space for addition of a furnace nose The nose is formed by bending the rear wall membrane panel. The nose protrudes into the furnace and terminates near the rear of wingwall and cyclone burner riser tube sections 52, 64. The nose diverts and concentrates the gas flow between these sections, thus improving gas distribution along the furnace depth at the nose elevation. Although noses have been commonly used in the past, it is the combination of the nose addition and its close proximity to the wingwall and cyclone burner riser tube sections that is also unique and is believed to improve gas distribution entering the convection pass heating surface compared to prior art.

There are believed to be several advantages of this invention.

The inventive system is believed to improve the mixing and uniformity (i.e. reduce stratification) of combustion gases flowing up through the furnace and into the convection pass surface which may yield the following advantages:

(1) reduced furnace refractory maintenance, (2) reduced sootblowing and waterwashing frequency, (3) higher unit efficiency, (4) lower potential for convection pass plugging, erosion and corrosion, (5) smaller furnaces and convection pass tube banks, (6) lower convection pass tube metal temperatures, (7) lower potential for furnace cooling water upsets, (8) improved controllability of in-furnace de-$NO_x$ system, and (9) improved controllability of boiler.

Figure 1A:
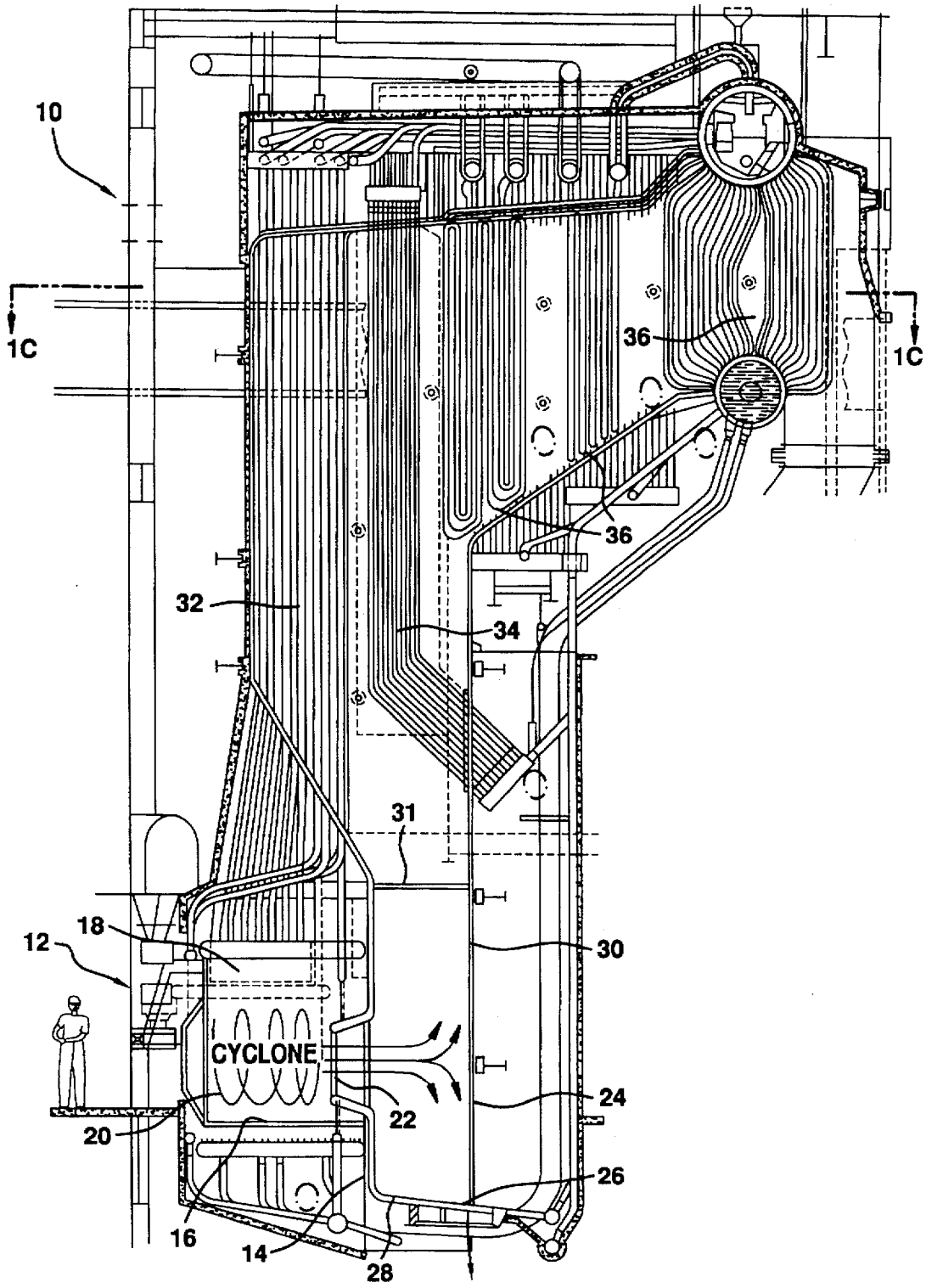
FIG.1A PRIOR ART
FIG. 1A is a schematic side elevational view of a boiler with cyclone furnace in accordance with the prior art.
Figure 1B:
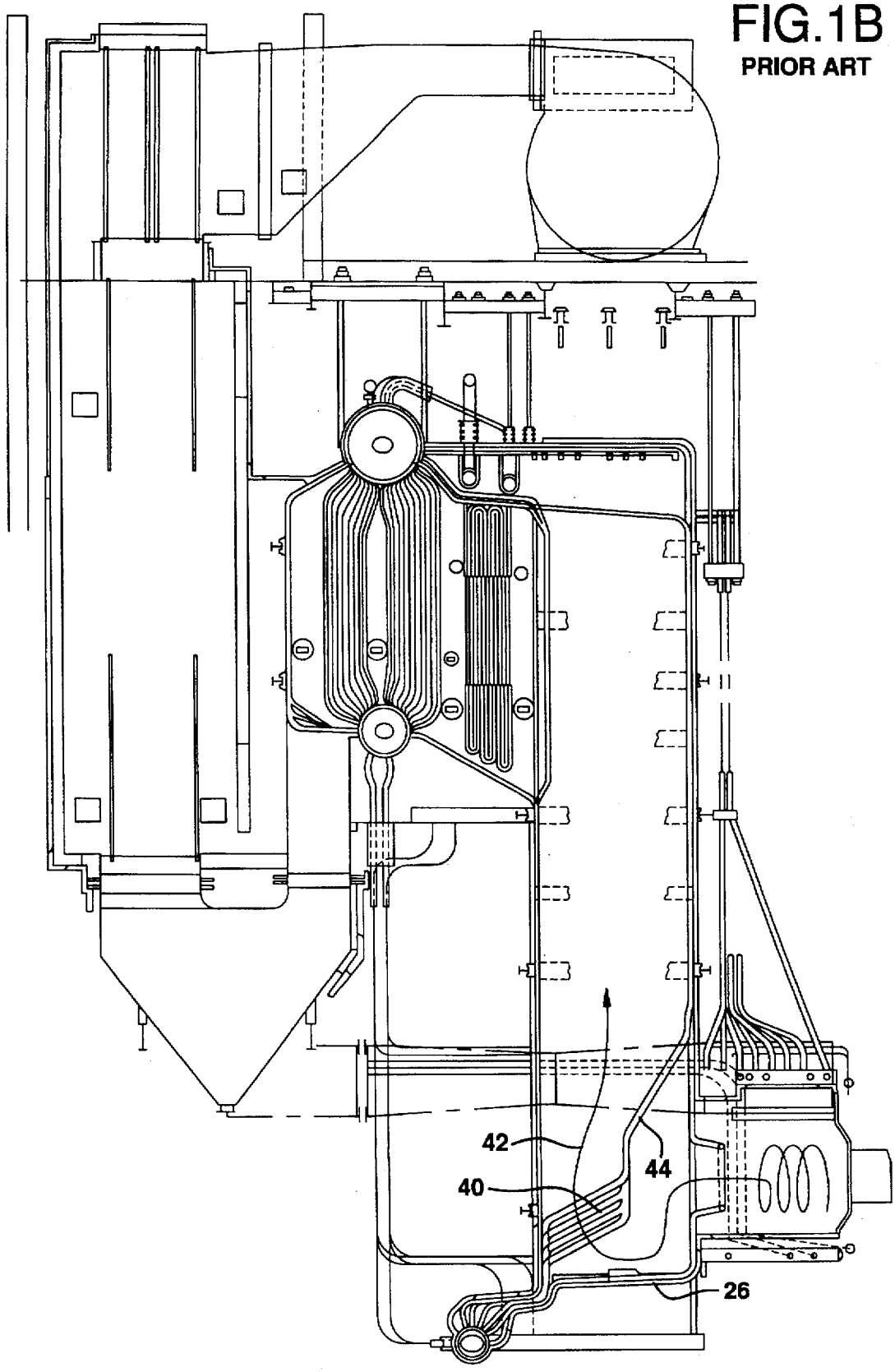
FIG.1B PRIOR ART
FIG. 1B is a schematic vertical sectional view of another known cyclone fired boiler.
Figure 1C:
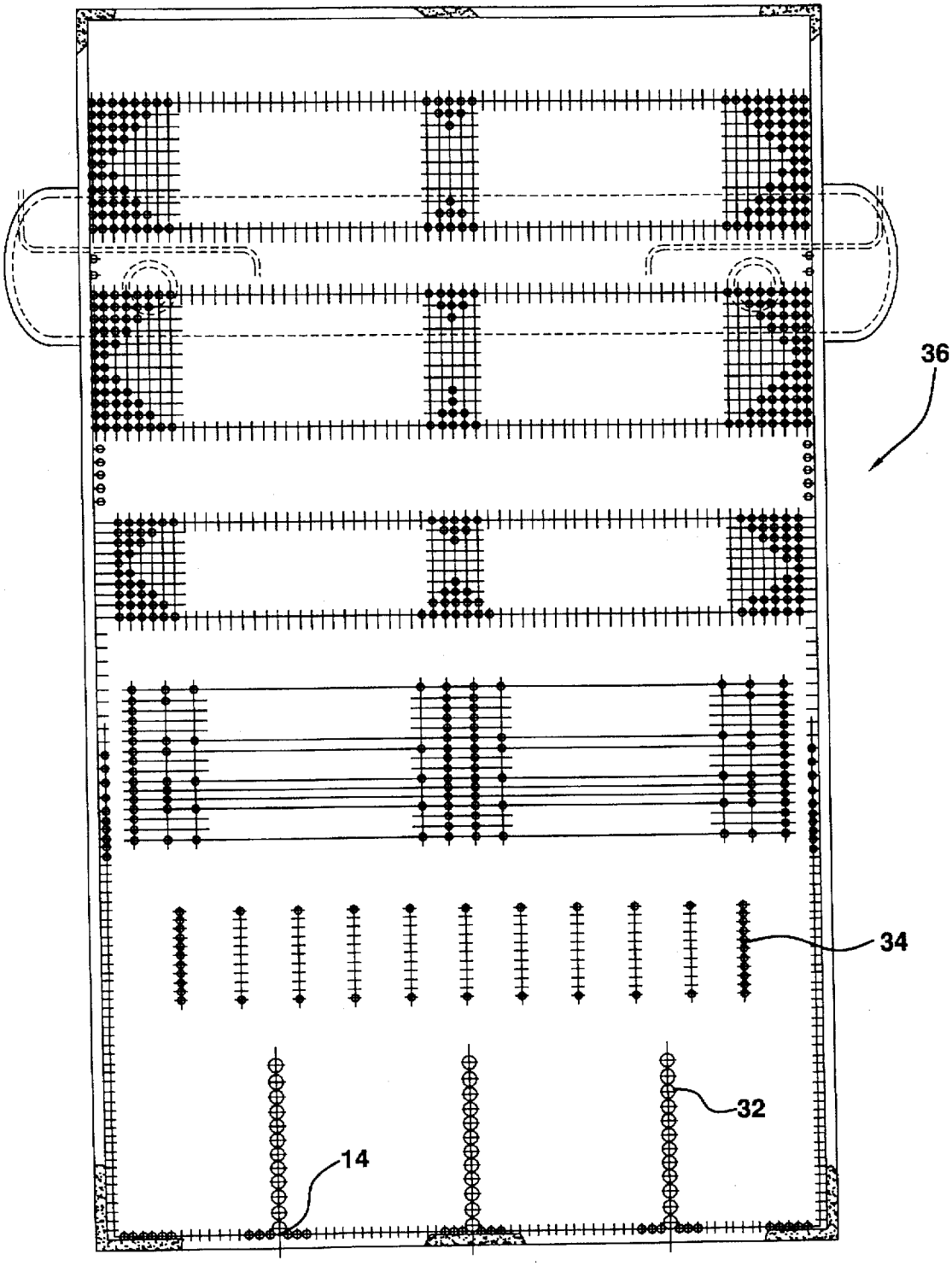
FIG.1C PRIOR ART
FIG. 1C is a schematic sectional view taken along line 1C—1C of FIG. 1A.

As alternatives that are within this invention, the wingwall tube sections do not have to be integral to the slag screen and can originate at the lower furnace rear wall (similar to the prior art per FIG. 1A) and extend horizontally across the lower furnace to and up along the front wall 60 or originate at the front wall just above the slag screen baffle 62.

The wingwall tube sections and nose can also be any size and configuration so as to suit furnace size and configuration.

The invention can be applied to non-boiler applications where general improvement of flow distribution is required.

The screen, wingwall tube sections and nose need not be water-cooled and can be made of any material and cross section suitable for the intended environment.

The invention can be applied to cyclone combustion of liquid or gaseous fuels, either alone or in combination with solid fuels. That is, the invention is independent of fuel type.

The invention can be applied to other boiler types and is not limited to only cyclone-fired boilers either.

While a specific embodiment of the invention has been shown and described in detail to illustrate the application of the principles of the invention, it will be understood that the invention may be embodied otherwise without departing from such principles.

What is claimed:

1. An apparatus for improving mixing and uniformity of furnace combustion gases in a boiler having a lower furnace with a front wall, a rear wall, and a furnace floor, and an upper furnace, the apparatus comprising:

a cyclone burner having an outlet for combustion gases opening into the front wall of the lower furnace for discharging the combustion gases horizontally into the lower furnace;

a slag screen baffle situated in the lower furnace and spaced away from the burner outlet, the slag screen baffle including an inclined upper part extending toward the front wall of the furnace;

a slag screen connected to the slag screen baffle and situated in the lower furnace, the slag screen extending toward the rear wall of the lower furnace from a lower end of the slag screen baffle, the slag screen baffle diverting combustion gases from the burner outlet first downwardly and then upwardly through the slag screen;

a plurality of wingwall sections supported by and extending from the front wall into the upper furnace and above the lower furnace past which the combustion gases flow for being cooled by the wingwall sections;

a plurality of cyclone burner riser sections positioned between the wingwall sections above the slag screen, the cyclone burner riser sections extending into the upper furnace; and a furnace nose extending into the furnace from the rear wall of the furnace and above the lower furnace for diverting the combustion gases between the wingwall sections.

2. An apparatus according to claim 1, wherein at least one of the slag screen, slag screen baffle and wingwall sections is made of tube wall for passing heat transfer fluid.

3. An apparatus according to claim 2, wherein the slag screen, slag screen baffle and wingwall sections are all made of tube wall for passing heat exchange fluid, the tube walls of the slag screen, slag screen baffle and wingwall sections being connected to each other.

4. An apparatus according to claim 1, wherein the lower furnace includes a floor having a slag tap opening for discharging slag therefrom.

5. An apparatus according to claim 4, wherein the lower furnace has refractory-covered front, sides and rear walls and a refractory-covered floor.

6. An apparatus according to claim 1, wherein the cyclone burner riser and wingwall sections are made of tube walls, the wingwall sections being positioned between the cyclone burner riser sections.

7. An apparatus according to claim 1, wherein the upper furnace is free of any saturated platens.

* * * * *